US009409201B2

(12) United States Patent
Summons et al.

(10) Patent No.: US 9,409,201 B2
(45) Date of Patent: Aug. 9, 2016

(54) SYSTEM AND METHOD OF PROVIDING INDIVIDUAL QUANTITIES OF CUSTOM COLORED SEALING COMPOUND

(71) Applicant: Sashco, Inc., Brighton, CO (US)

(72) Inventors: Wayne Summons, Thornton, CO (US); Elliot Summons, Centennial, CO (US)

(73) Assignee: SASHCO, INC., Brighton, CO (US)

( * ) Notice: Subject to any disclaimer, the term of this patent is extended or adjusted under 35 U.S.C. 154(b) by 0 days.

(21) Appl. No.: 14/318,888

(22) Filed: Jun. 30, 2014

(65) Prior Publication Data

US 2014/0319166 A1 Oct. 30, 2014

Related U.S. Application Data

(63) Continuation of application No. 13/037,011, filed on Feb. 28, 2011, now Pat. No. 8,800,816, which is a continuation-in-part of application No. 12/410,301, filed on Mar. 24, 2009, now Pat. No. 8,100,296, which is a continuation of application No. 12/053,865, filed on Mar. 24, 2008.

(51) Int. Cl.

| | |
|---|---|
| ***B67D 7/74*** | (2010.01) |
| ***B05C 17/005*** | (2006.01) |
| ***B05C 17/00*** | (2006.01) |

(52) U.S. Cl.

CPC ..... *B05C 17/00593* (2013.01); *B05C 17/003* (2013.01); *B05C 17/0052* (2013.01); *B05C 17/00553* (2013.01); *B05C 17/00556* (2013.01); *B05C 17/00563* (2013.01); *B05C 17/00583* (2013.01); *B05C 17/00513* (2013.01)

(58) Field of Classification Search

CPC ..... B05C 17/003; B05C 17/00553; B05C 17/00556; B05C 17/00583; B05C 17/00563; B05C 17/00593; B05C 17/0052; B05C 17/00513

USPC ..... 222/129, 142, 142.1, 327, 543, 325, 222/326, 386, 391; 220/629; 206/219, 221; 141/114

See application file for complete search history.

(56) References Cited

U.S. PATENT DOCUMENTS

| | | | | | |
|---|---|---|---|---|---|
| 3,417,910 | A | * | 12/1968 | Johnson | 229/117.25 |
| 3,735,900 | A | * | 5/1973 | Gores | 222/129 |
| 4,350,774 | A | * | 9/1982 | Scotti et al. | C08J 9/14 222/394 |
| 4,826,047 | A | * | 5/1989 | Heflin | 222/136 |
| 4,953,729 | A | * | 9/1990 | Kloosterhouse | 215/255 |
| 5,129,520 | A | * | 7/1992 | Gaspar | 206/534 |
| 5,277,303 | A | * | 1/1994 | Goyet et al. | 206/221 |
| 5,297,697 | A | * | 3/1994 | Boring | 222/83 |

(Continued)

*Primary Examiner* — Patrick M Buechner
*Assistant Examiner* — Jeremy W Carroll
(74) *Attorney, Agent, or Firm* — Perkins Coie LLP

(57) ABSTRACT

A system and method for providing custom colored sealant are generally provided with a dispensing container, containing a quantity of sealant base solution. A bottom wall of the dispensing container is positioned to limit any headspace within the interior of the dispensing container until the contents are ready to be mixed. The bottom wall is moved prior to adding a coloring agent to the dispensing container, which is mixed with the sealant base by agitating the dispensing container, until a desired color is attained. A sealant thickener may then be added and mixed by similar agitation of the dispensing container. A rod may be provided to engage and move the bottom wall. A pull string may also be provided to move the bottom wall. A nozzle is then coupled with the dispensing container and the custom-colored sealant is ready to be dispensed.

14 Claims, 23 Drawing Sheets

(56) References Cited

U.S. PATENT DOCUMENTS

| | | | | |
|---|---|---|---|---|
| 6,244,467 | B1 * | 6/2001 | Lewit | 222/107 |
| 6,372,270 | B1 * | 4/2002 | Denny | 426/77 |
| 6,959,807 | B2 * | 11/2005 | Sharon et al. | 206/219 |
| 7,798,363 | B2 * | 9/2010 | Brandon | 222/1 |
| 2002/0020718 | A1 * | 2/2002 | Summons et al. | 222/327 |
| 2003/0150748 | A1 * | 8/2003 | Crawley | 206/219 |
| 2007/0109910 | A1 * | 5/2007 | Anderson et al. | 366/69 |
| 2007/0251839 | A1 * | 11/2007 | Jessop et al. | A61C 5/062 206/221 |
| 2009/0114684 | A1 * | 5/2009 | Helmenstein | 222/538 |

* cited by examiner

SYSTEM AND METHOD OF PROVIDING INDIVIDUAL QUANTITIES OF CUSTOM COLORED SEALING COMPOUND

CROSS-REFERENCE TO RELATED PATENT APPLICATIONS

This patent application is a continuation of U.S. patent application Ser. No. 13/037,011, filed Feb. 28, 2011, now U.S. Pat. No. 8,800,816, which is a continuation-in-part of U.S. patent application Ser. No. 12/410,301, filed on Mar. 24, 2009, now U.S. Pat. No. 8,100,296, which is a continuation of U.S. patent application Ser. No. 12/053,865, filed Mar. 24, 2008, now U.S. Pat. No. 9,352,354, the contents of each of which are hereby incorporated by reference herein in its entirety.

BACKGROUND

The construction and home improvement arts frequently need custom colored sealants for the improved aesthetic appearance of a wide array of projects. Common substrates where precisely color-matched caulks are needed and desired include: painted surfaces, stained surfaces, counter tops, wall paper, pre-colored siding materials, brick, stone, tile, bath and kitchen fixtures, flooring, etc. While some factory-tinted, non-custom colored caulks are available in the trade (with white being the overwhelmingly dominant color), most such colors of caulk do not match the substrates they are applied to very well.

At least one company has provided custom color-matching of individual containers of caulk. However, the custom color-matching has only been done by the company itself and only at its factory. Accordingly, such a custom-coloring service only works when: 1) the consumer or contractor is willing or able to wait several days or weeks for color submittals and then delivery from the factory; 2) the consumer is willing to purchase a relatively large volume of custom-colored caulk; and 3) the consumer is willing to pay a very high price for such factory-made custom colors of caulk.

Consumers and contractors have not been able to go to a local paint store and conveniently purchase quantities of paint or stain and custom tinted containers of sealant at the same time. In particular, the long-standing and unmet need in the market has centered around the ability to: custom tint small or large quantities of cartridges or squeeze tubes of sealant at a time; acquire custom tinted sealant at a low-to-moderate cost; and custom tint sealant without waiting for extended periods of time. To date, these aggregate criteria have been heretofore unavailable.

Some of the key difficulties that have prevented the resolution of such problems in the prior art have centered on several issues. For example, the high viscosity of typical sealant products has made it very difficult or impossible to easily and uniformly mix liquid or dry colorants throughout the sealant. In contrast with this problem, adding and mixing liquid or dry colorants into products with lower viscosities, such as latex paint, has been relatively easy. The basic elongated geometry of standard sealant containers, which produces a high aspect-ratio container, presents another difficulty to overcome. Colorants that are introduced into one end of such elongated containers are difficult to uniformly distribute throughout the entire length of the containers. Moreover, most systems require that the containers of sealant be mixed one at a time, which can waste valuable time while attempting to complete jobs.

Several approaches have either been proposed or commercially attempted previously to allegedly allow for an easy, fast, convenient, and inexpensive method for the custom-coloring of individual containers of caulk at or near the location in the field where the caulk is to be used. While some of the approaches taken have delivered a low level of partial success at in-the-field custom coloring of caulk in individual rigid caulk cartridges, none have provided the needed ease of mixing and dispensing, economy, speed, and ability to simultaneously mix several containers of sealant at once. Moreover, none of the prior attempts have made it possible to custom tint small or large numbers of flexible squeeze tubes of caulk; leaving a great unmet need in the art.

U.S. patent application Ser. No. 12/053,865, entitled "System and Method of Providing Individual Quantities of Custom Colored Sealing Compound," to which this application claims priority, teaches an elegant solution that includes individual quantities of a sealant base, colorant, and sealant thickener. The base is provided in a dispensing container. When the user is ready to make and use the custom colored sealant, the user adds the colorant until the desired color is attained. Then the thickener is added and the solution, after additional agitation of the dispensing container, is ready to use. However, the colorant and thickener add volume to the original volume of sealant base. Where a significant headspace is provided to accept volumes of colorant and thickener at a point of use, the sealant base can oxidize or coalesce on the sides of the container during long periods of heated storage and develop a skin. This skin is not desirable as it does not adequately mix with either the colorant or the thickener. Accordingly, the skin is later expelled from the dispensing container, uncolored and of the wrong consistency, while the user applies the sealant. This creates waste and time delays as the user is forced to remove the bead of sealant where the skin was expelled and reapply the bead.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

A system and method are presented for custom coloring sealants, such as caulk. In one aspect, the system includes a dispensing container, having an open end portion that is in open fluid communication with an open interior compartment. A quantity of sealant base solution is disposed within the interior compartment of the dispensing container. In some embodiments, the interior compartment is sized so that there is little, if any, appreciable open headspace associated with the sealant base solution. A nozzle, having an open interior portion and opposite first and second end portions, is provided such that the first end portion may be secured with the open end portion of the dispensing container to permit dispensing of the sealant. A supplemental container may be provided that is at least partially filled with a quantity of sealant thickener. A quantity of at least one coloring agent is also made available. A second supplemental container, such as a syringe, may be provided for incrementally adding an amount of coloring agent to the mixture within the dispensing container.

In use, the interior compartment of the dispensing container is resized so that an appreciable, open headspace is associated with the sealant base solution. In various embodiments, the headspace is sized to exceed an anticipated or predetermined volume of colorant and thickener. In this manner, additional materials may be added to the sealant base solution and agitated in a manner that mixes the contents of the dispensing container. The interior compartment of the dispensing container is resized by moving the bottom wall of the dispensing container. In some embodiments, the system may be provided with an elongated pushrod that is shaped to be selectively passed through an open first end portion of the dispensing container until it engages the bottom wall of the dispensing container 12. The user may then continue to drive the pushrod into the interior compartment of the dispensing container, such that the bottom wall moves to a second position, which defines a second, larger interior volume. The second volume 82 will generally be sufficient to simultaneously hold a quantity of sealant base solution, a quantity of sealant thickener, and a quantity of colorant, while maintaining sufficient headspace to mix the contents by agitation or other means. Other methods of moving the bottom wall may include removably securing the pushrod to a bottom surface of the bottom wall, allowing the user to pull the bottom wall to a new position. Similarly, a pull string may be secured with the bottom wall to provide a user with a gripping mechanism for moving the bottom wall.

Once the bottom wall has been moved to create the second volume, the user may dispose a quantity of at least one coloring agent to the sealant base. The dispensing container is then shaken until a desired, uniform color is attained. The supplemental container is then removed from a storage position and the sealant thickener is then dispensed from the supplemental container into the dispensing container and the dispensing container is again shaken to thoroughly mix the contents. The nozzle may then be engaged with the open end portion of the dispensing container. In one aspect, a portion of the nozzle is removed by cutting the tip off. The custom colored caulk may then be dispensed at a point of use.

In its various embodiments, the present system and method provide an easy means of allowing a consumer or contractor to homogeneously custom color individual containers of sealant at the job site. Rigid, standard caulk cartridges and flexible squeeze tubes may be used, interchangeably, without the need for additional mixing equipment. The system and method further allow the custom colored caulk to be very easily dispensed from the dispensing container after the user manually mixes the components with a simple shaking motion of the dispensing container. The amount of time required for accomplishing the needed color mixing is greatly reduced from other methods, with virtually no mess or loss of product. Moreover, the present system and method allow the user to gain easy, non-messy access to the inside of the dispensing container so as to easily introduce the required volume of coloring agent.

These and other aspects of the present system and method will be apparent after consideration of the Detailed Description and Figures herein.

DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

Figure 1:
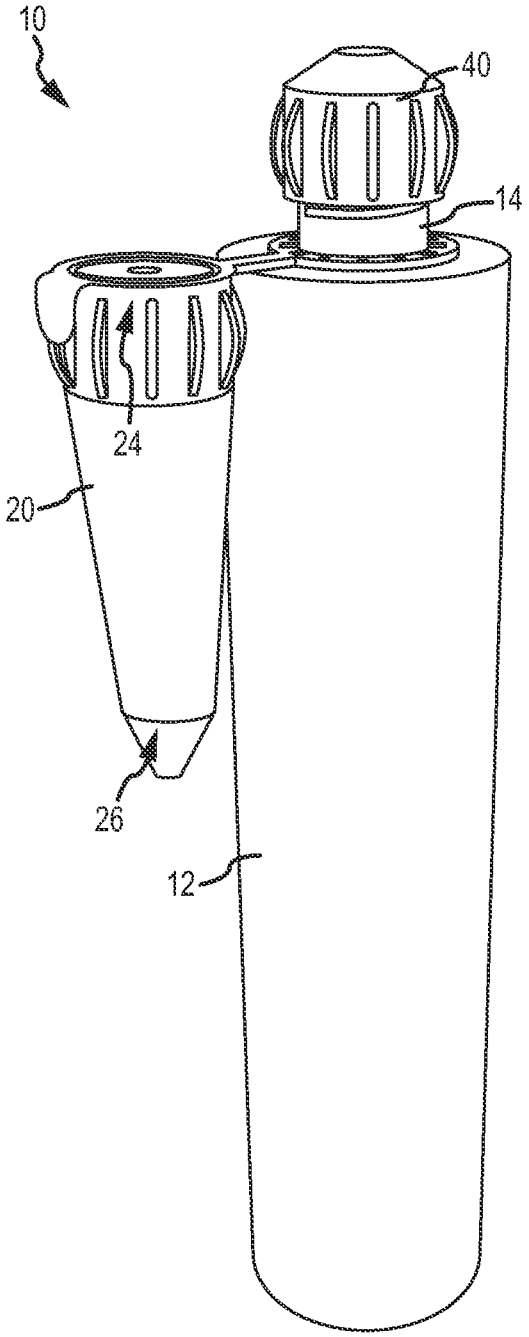
FIG. 1 depicts a front elevation view of one embodiment of the system for custom coloring sealant.

With reference to FIG. 1, the system 10 for custom coloring sealant may be provided with dispensing container 12, which in various embodiments takes the form of a rigid cylindrical caulk cartridge, and the like. The dispensing container 12 will have a first open end portion 14, which is in open fluid communication with an open interior compartment 16, and a bottom wall 17 that is selectively positionable at various locations along a long axis of the dispensing container 12, within the open interior compartment 16, toward and away from the open first end portion of the dispensing container 12. The interior compartment 16 of the dispensing container 12 will be at least partially filled at the factory with a very low viscosity sealant base solution 18.

The system 10 is provided with a nozzle 20, having an open interior portion 22 that is bordered by an open first end portion 24 and an opposite second end portion 26. In at least one aspect, the first end portion 24 is shaped and sized to be secured with the open end portion 14 of the dispensing container 12, so that the interior compartment 16 of the dispensing container 12 may be placed in open fluid communication with the interior portion 22 of the nozzle 20. In at least one embodiment, the first open end portion 14 of the dispensing container 12 is provided with a hollow, threaded nub 28. In this manner, the open first end portion 24 of the nozzle 20 may be provided with mating threads that are shaped to operatively engage the threaded nub 28. In one aspect, the diameter of the threaded nub 28 may be provided to be at least ⅝", which provides approximately 56.3% more flow area than standard ½" diameter ports found on common caulk cartridges. Moreover, an enlarged diameter provides greater ease of access for materials that are to be added to the dispensing container 12. It is contemplated, however, that a wide array of different diameters may be used to form the threaded nub 28.

Liquid latex caulk base is an example of a sealant base solution 18 that may be used with the system 10. In one aspect, the sealant base solution 18 liquid latex caulk base is formulated to a bluish or purplish shade. When the sealant cures, it presents a "water-clear" appearance (similar to a pool of clean water) with a blue to purple cast in order to enhance the "cleanness" of the ultimate color achieved by the end user by counteracting any undesirable amber or yellowish tones that can frequently occur otherwise when some sealants are formulated to cure to a "clear" appearance. In at least one embodiment, the viscosity of the sealant base solution is in the range of 100 to 50,000 centipoise at low shear rates. Such levels of viscosity assist in making hand-mixing readily doable of the sealant base solution 18 with liquid or dry colorant that is added to the dispensing container. In one aspect, the aforedescribed viscosity range is at least an order of magnitude lower than a common viscosity range of caulk bases used in the art.

In at least one embodiment, a representative formula for a generalized low-viscosity sealant base solution described above (with many possible variations from this example also being possible), is as follows:

| | | |
|---|---|---|
| Rhoplex 2620 | 84.16% | Acrylic latex emulsion |
| T-Det N-407 | 0.18% | Surfactant |
| Water | 3.35% | Solvent |
| Mergal 395 | 0.14% | Biocide |
| Ethylene Glycol | 0.92% | Anti-freeze agent |
| 100LV Light Base Oil | 8.21% | Plasticizer |
| Ammonium Hydroxide 26BE | 0.25% | pH adjuster |
| Polyphase 678 | 0.10% | Biocide |
| Silquest A-1106 | 0.18% | Adhesion promoter |
| Zinplex 15 | 2.48% | Cross-linking agent |
| Violet dye/IPA solution | 0.05% | Yellow-neutralizing dying agent |
| Total > | 100.0% | |

Physical properties of the above sealant base solution include:

| | |
|---|---|
| Density > | 8.66 lbs/gallon |
| pH > | 7.11 |
| Viscosity > | 7,000 centipoise (Brookfield, #63 spindle @ 3 rpm) |
| Percent solids > | 59.57% |
| VOC content > | 26.69 grams/liter |

Figure 2:
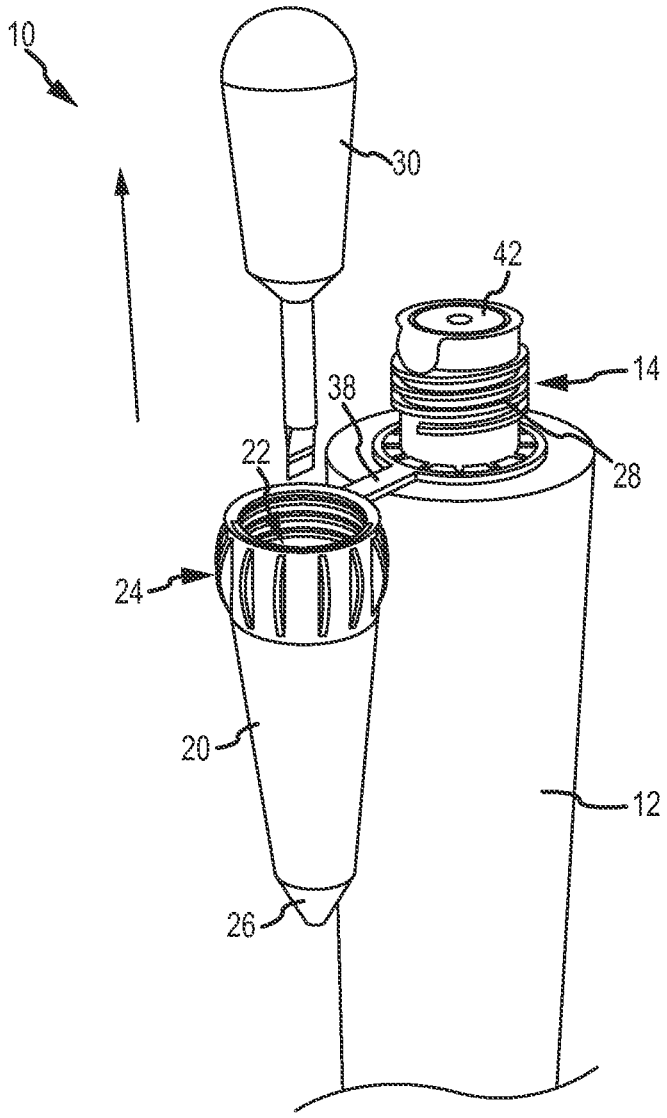
FIG. 2 depicts an isometric view of one embodiment of a nozzle and supplemental container that may be used with the system for custom coloring sealant and demonstrates one manner in which the supplemental container may be removed from a storage position within the nozzle.
Figure 10:
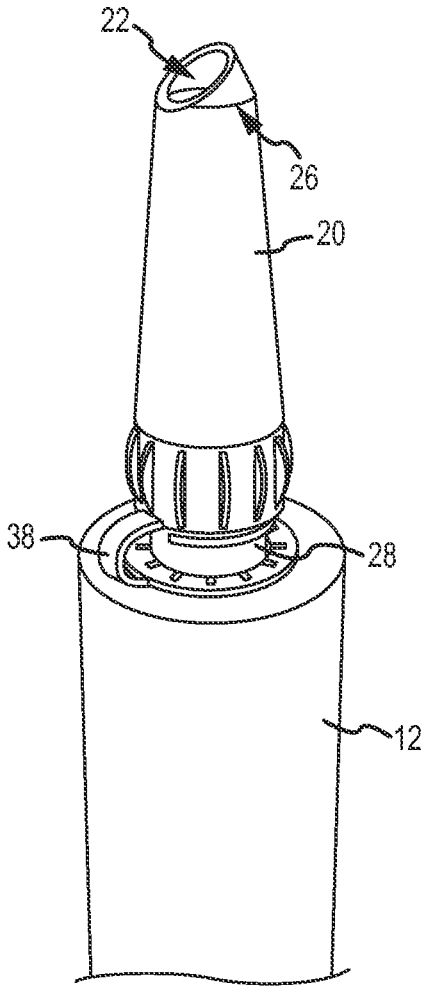
FIG. 10 is an isometric view of one embodiment of a nozzle and dispensing container that may be used with the system for custom coloring sealant and demonstrates one manner in which the nozzle may be opened to permit dispensing of the contents of the system.
Figure 11:
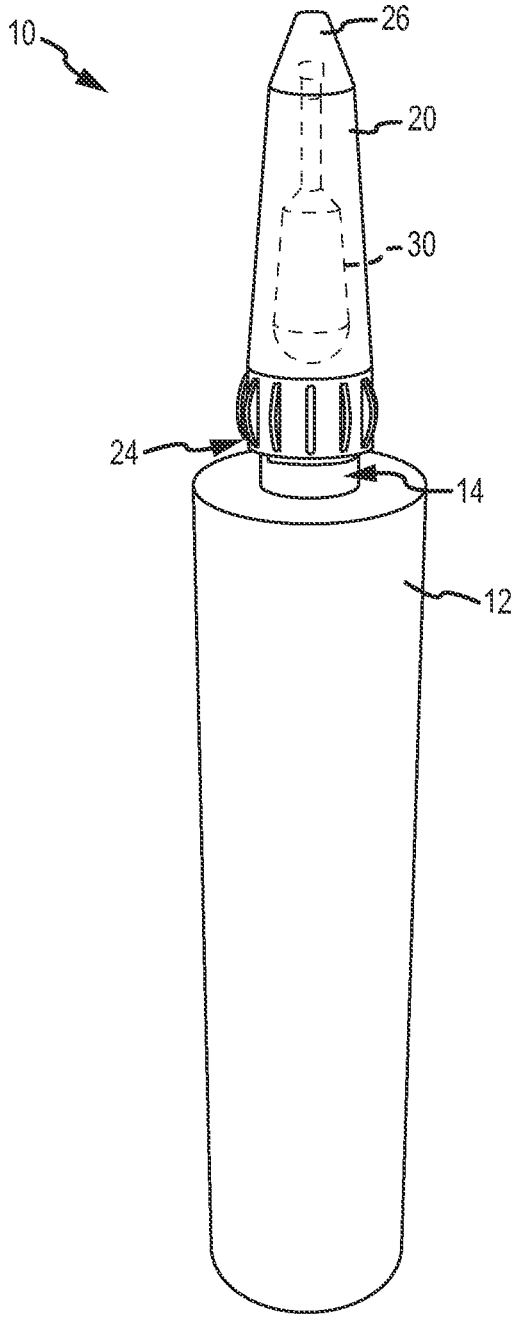
FIG. 11 depicts a front elevation view of one embodiment of the system for custom coloring sealant and demonstrates one manner in which the same may be assembled prior to its use.

With reference to FIGS. 2, 10 and 11, a supplemental container 30 may be provided, having an interior portion 32 that is at least partially filled with a quantity of sealant thickener 34. It is contemplated that the shape and size of the supplemental container may vary according to the circumstances and intended uses. However, in at least one embodiment, the supplemental container 30 is shaped and sized to fit within the interior portion 22 of the nozzle 20, having a lower bulb portion and an upper stem that may have a portion removed to gain access to the interior portion. Alternatively, the nozzle 20 may be filled with the liquid or dry sealant thickener 34, with the open first end portion 24 of the nozzle 20 sealed with, for example, a seal such as a foil laminated seal that is heat sealed to the open first end portion of the nozzle 20. Examples of sealant thickeners suitable for producing non-sag caulk viscosity, when such agents are introduced into the sealant base solution 18 described above, include, but are not in any way limited to: ammonium hydroxide, sodium hydroxide, potassium hydroxide, 2-amino methyl propanol, Acrysol ASE-60, Acrysol SCT-275, Acrysol RM-2020, Acrysol RM-825, Carbopol Aqua SF-1, Polyphobe 106HE, Tafigel PUR-61, Methocel, Bermocoll, Tylose, Rheolate 1, Rheolate 425, etc.

It must be understood, however, that the examples of thickening agents and sealant base solutions disclosed above are merely representative of a virtually infinite number of variations in raw materials and formula-proportions that could yield a similar final result for one skilled in the art of formulating sealants. For example, while the above sealant base solution is founded on the use of an acrylic latex emulsion polymer (Rhoplex 2620), the following polymer emulsion types could, without limitation, also be used to a similar effect: styrene-acrylic polymers, ethylene-vinyl acetate polymers, styrene-butadiene polymers, urethane polymers, acrylic-urethane polymers, vinyl acetate polymers, butyl polymers, and the like. Similar variations, without limitation, are equally possible for such formula-dependent raw materials as: surfactants, biocides, anti-freeze agents, plasticizers, pH control agents, adhesion promoters, cross-linking agents, dying agents, texturizing agents, solvents, matting agents, etc.

Figure 13:
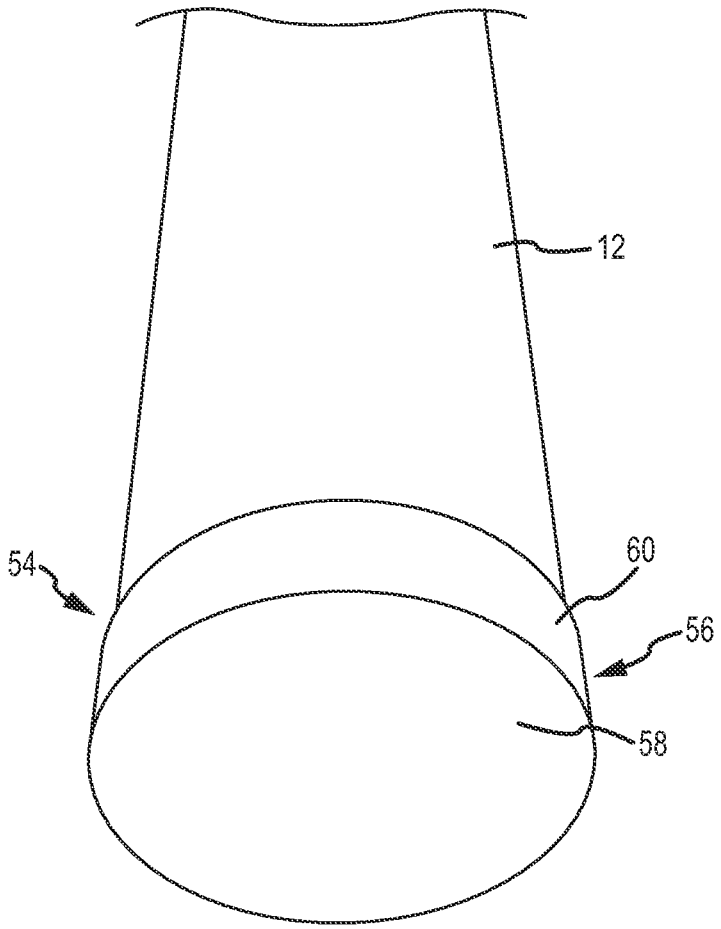
FIG. 13 depicts a bottom, perspective view of another embodiment of the system for custom coloring sealant and demonstrates one manner in which a supplemental container may be temporarily stored within a recess at one end of the dispensing container.
Figure 14:
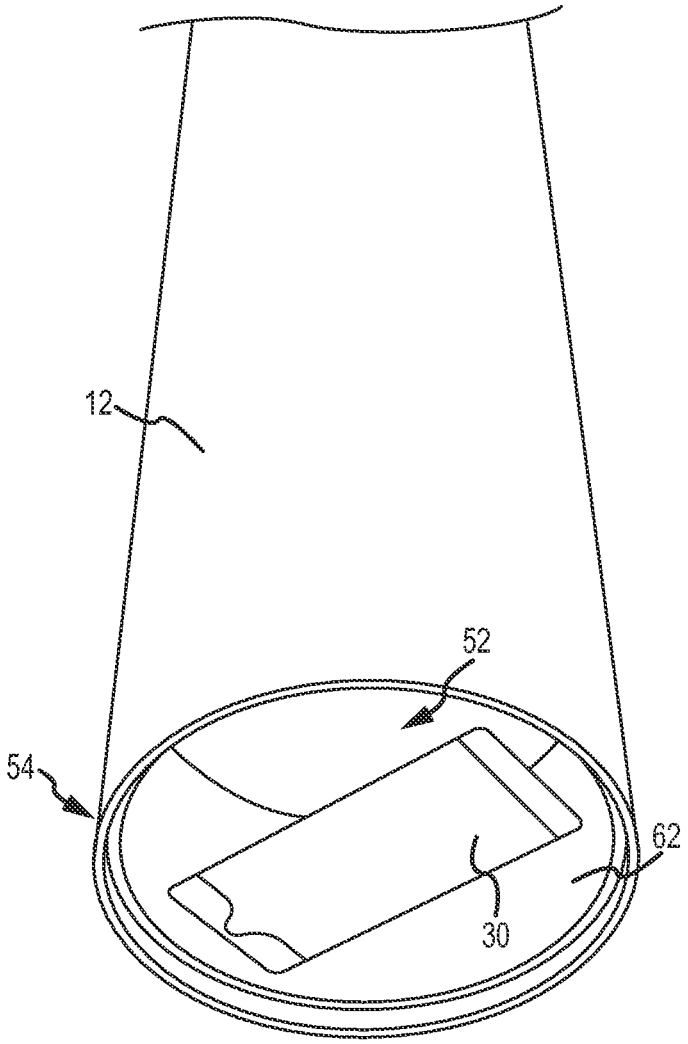
FIG. 14 depicts a bottom, perspective view of yet another embodiment of the system for custom coloring sealant and demonstrates another manner in which a supplemental container may be temporarily stored within a recess at one end of the dispensing container.
Figure 15:
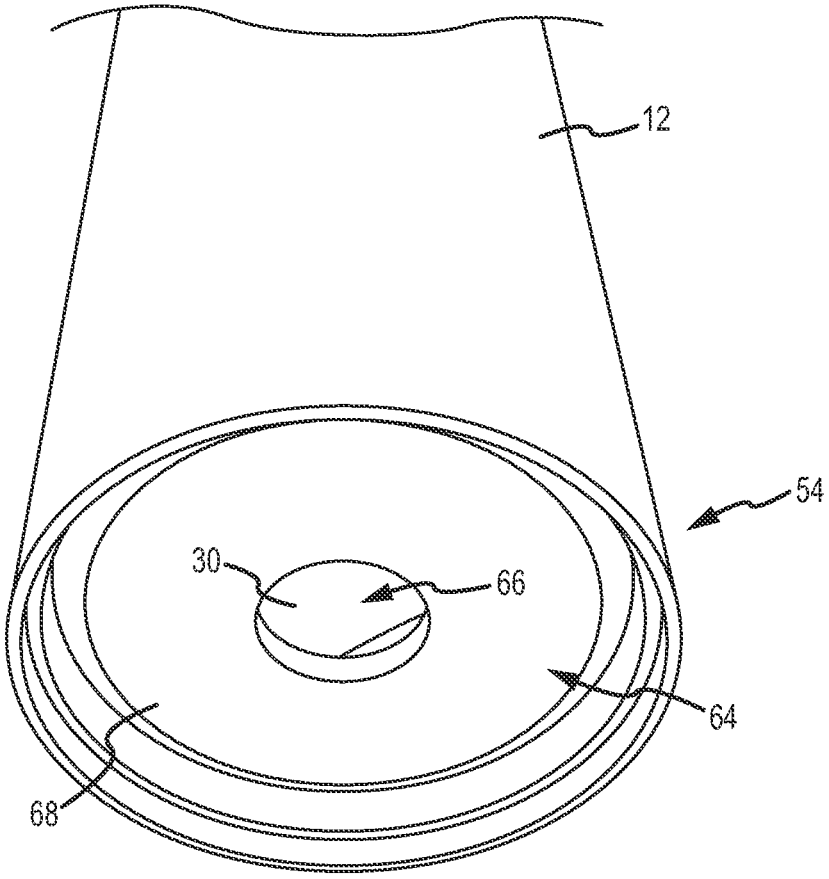
FIG. 15 depicts a bottom, perspective view of a further embodiment of the system for custom coloring sealant and demonstrates yet another manner in which a supplemental container may be temporarily stored within a recess at one end of the dispensing container.
Figure 16:
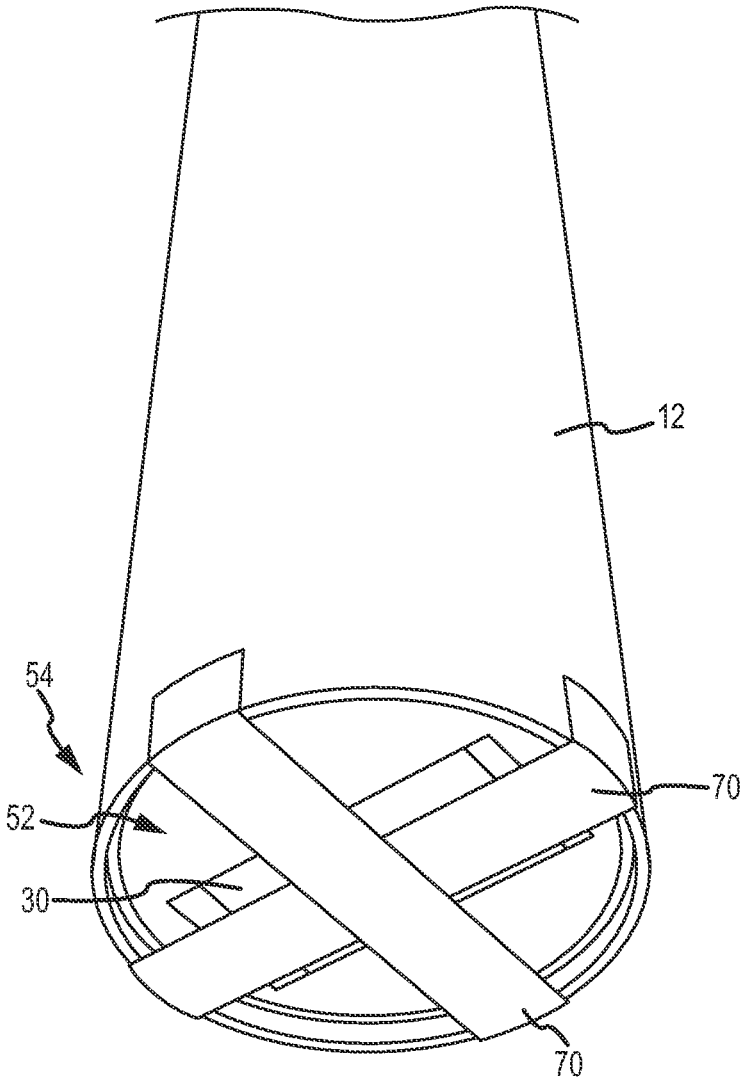
FIG. 16 depicts a bottom, perspective view of still another embodiment of the system for custom coloring sealant and demonstrates still another manner in which a supplemental container may be temporarily stored within a recess at one end of the dispensing container.

In still other embodiments, the bottom wall 17 of the dispensing container 12 may be shaped to have a recess 52 formed to open away from the interior compartment 16 near a second end portion 54 of the dispensing container 12. The supplemental container 30 may be removably disposed within the recess 52. In some embodiments, an opening to the recess 52 may be temporarily closed with a removable recess barrier that prevents the supplemental container 30 from being unintentionally dislodged from within the recess 52. With reference to FIG. 13, the removable recess barrier may be provided in the form of a cap 56 having a bottom wall 58 and at least one side wall 60 that depends from the bottom wall 58. It is contemplated that the cap 56 may be shaped to position the at least sidewall 60 in a friction-fit engagement with an exterior or interior face of the dispensing container. For example, FIG. 13 demonstrates one manner in which the cap 56 may engage the exterior surface of the dispensing container. In such an embodiment, the cap 56 may be pressed and pulled from its position enclosing the recess 52. FIGS. 14 and 15, on the other hand, demonstrate manners in which caps 62 and 64 may engage the interior face of the dispensing container. In some embodiments, the cap 62 may be formed of a material that is at least generally transparent to permit a manufacturer, retailer, or potential purchaser to quickly verify that a supplemental container 30 is disposed within the recess 52 and is in optimal condition. In some aspects, the cap 62 may be pried loose from its engagement position with the dispensing container 12 while in other aspects the material used to provide the cap 62 may be thin enough to be punctured to gain access to the recess 52. With reference to FIG. 15, an opening 66 may also be formed to penetrate the bottom wall 68 of the cap 64. The opening may be sized to prevent the passage of the supplemental container 30 through the opening, while large enough to permit a user to insert a finger or other object and pry the cap 64 from its engaged position with the dispensing container 12. Edge portions of the cap 64 may be chamfered to ease the manner in which the cap 64 is engaged with and removed from the recess 52. With reference to FIG. 16, the removable recess barrier may be provided in the form of one or more pieces of flexible material 70 that at least partially covers an opening to the recess in the dispensing container. In some embodiments, the flexible material may simply be pieces of tape. In such embodiments, the tape may be allowed to cover the opening to the recess 52 or directly secure the supplemental container 30 within the recess 52.

Figure 4:
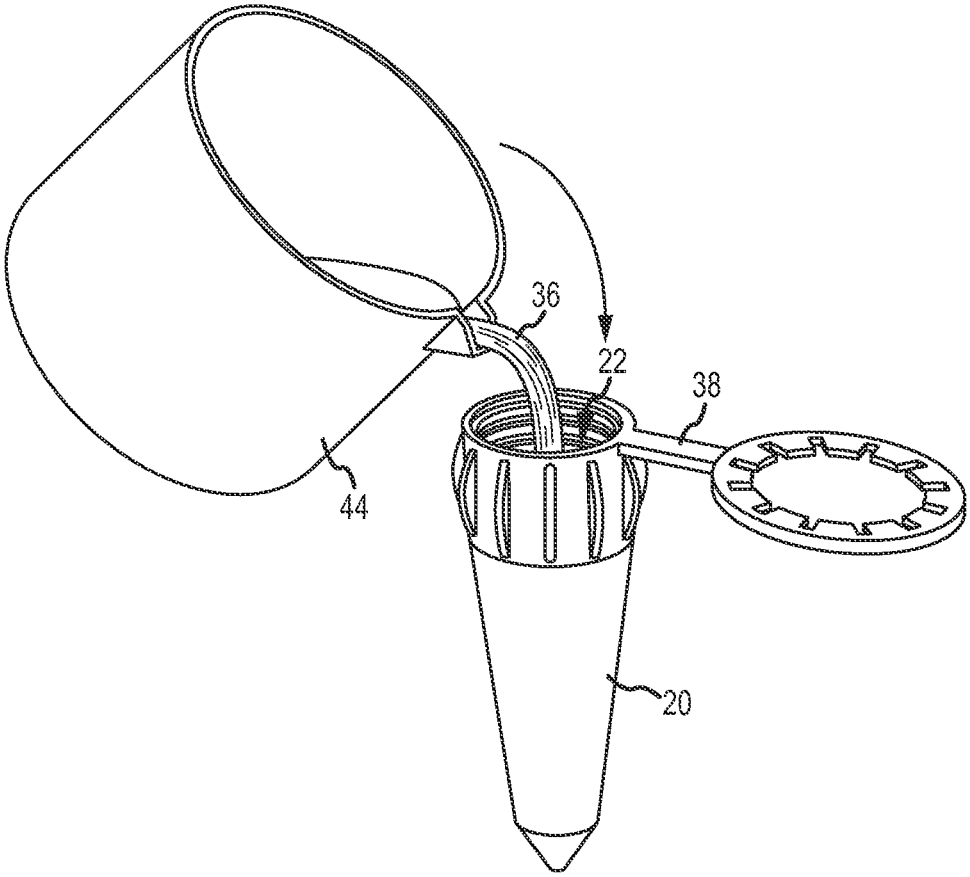
FIG. 4 is an isometric view of one embodiment of a nozzle that may be used with the system for custom coloring sealant and demonstrates one manner in which the nozzle may be used as a measuring device.
Figure 5:
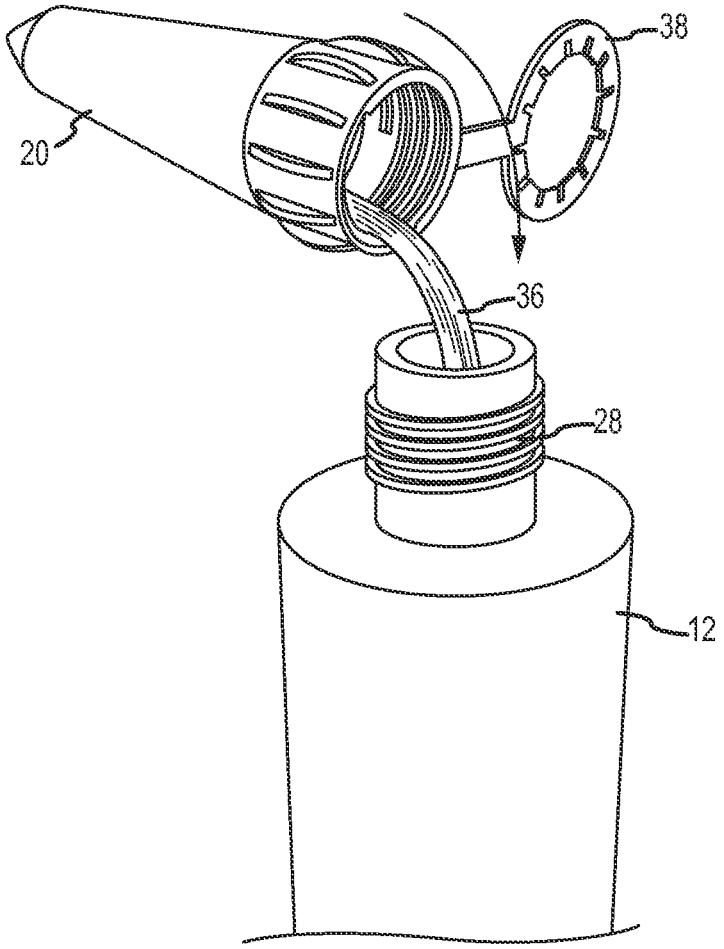
FIG. 5 is an isometric view of one embodiment of a nozzle and dispensing container that may be used with the system for custom coloring sealant and demonstrates one manner in which the nozzle may be used to introduce additive materials to the interior chamber of the dispensing container.
Figure 6:
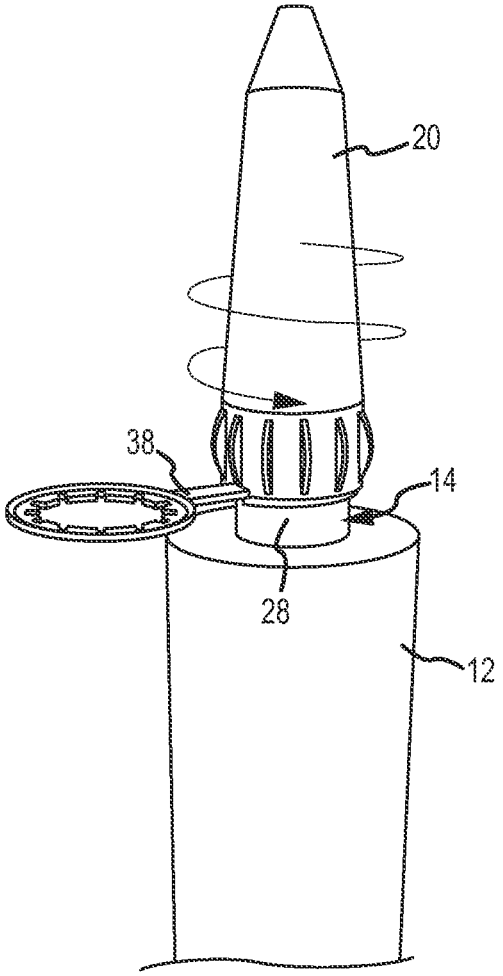
FIG. 6 is an isometric view of one embodiment of a nozzle and dispensing container that may be used with the system for custom coloring sealant and demonstrates one manner in which the nozzle may be secured with an open end portion of the dispensing container prior to agitating the contents of the dispensing container.
Figure 17:
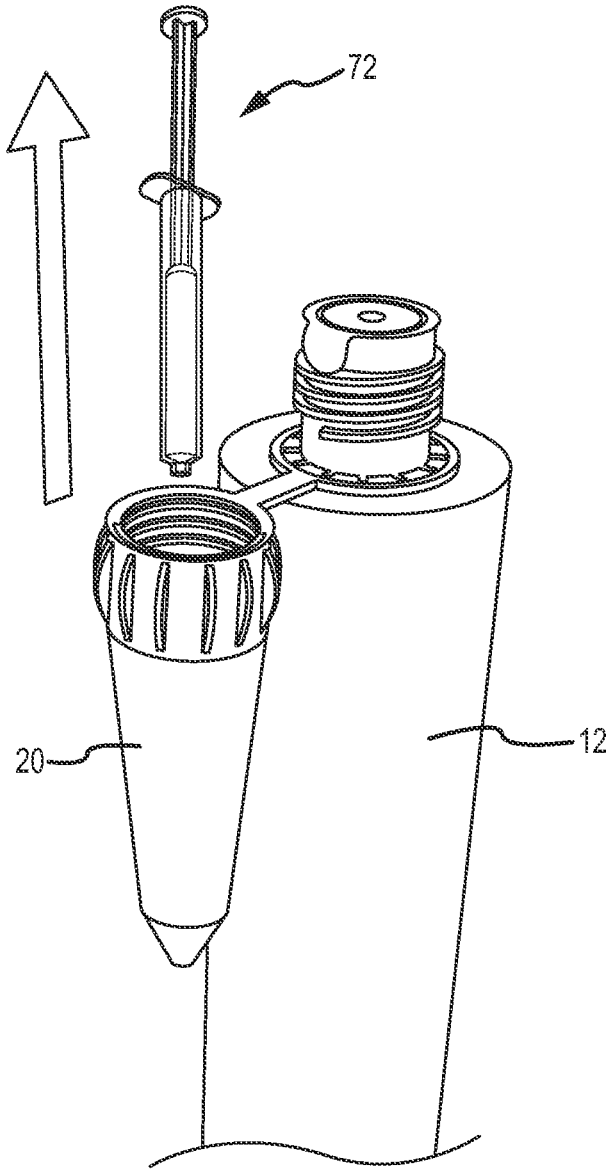
FIG. 17 depicts an isometric view of one embodiment of a nozzle and syringe that may be used with the system for custom coloring sealant and demonstrates one manner in which the syringe may be removed from a storage position within the nozzle.
Figure 22:
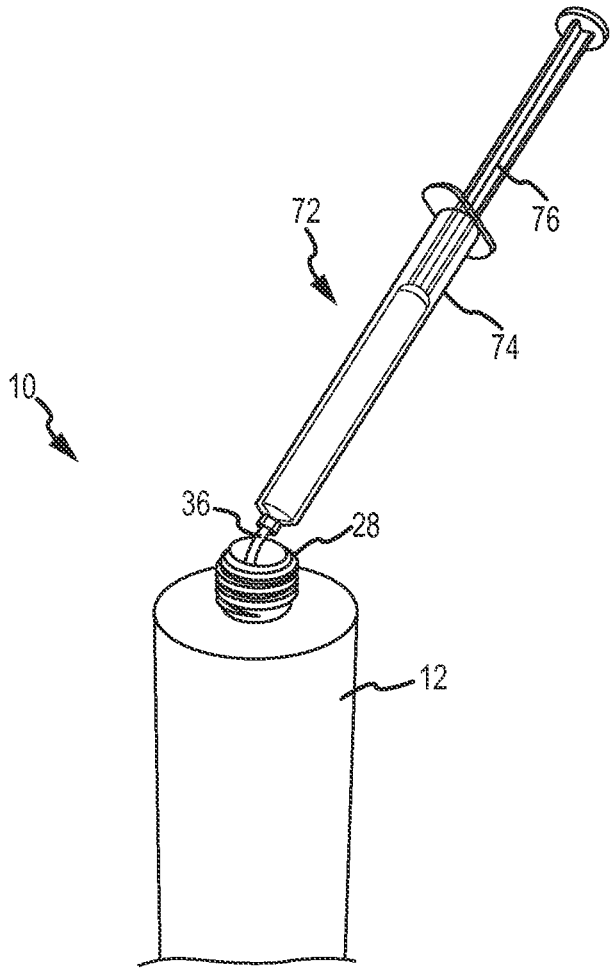
FIG. 22 depicts one embodiment of a dispensing container that may be used with the system for custom coloring sealant and demonstrates one manner in which a syringe may be used to add material, such as a colorant, to the interior compartment of the dispensing container.

With reference to FIG. 4, the system 10 should be provided with a quantity of at least one coloring agent 36. In one aspect multiple coloring agents 36 may be provided. It is contemplated that the coloring agent may take many different forms. For example, the coloring agent 36 may be comprised of liquid pigments, dry pigments, latex paint or latex stain. The coloring agent may be provided in a secondary supplemental container similar to that described for the supplemental container 30. However, it is also contemplated that the coloring agent will be provided by the end user in order to obtain a close color match to the substrate on which the sealant is to be used. With reference to FIGS. 17 and 22, a syringe 72 may be provided having a tubular base 74 with open first and second end portions and an elongated plunger 76 that is shaped to be disposed through the open second end portion of the base and along its open interior toward and away from the open first end portion. The syringe 72 may be at least partially filled with a quantity of a coloring agent 36. In this manner the user may use a large volume of coloring agent 36 and, using the syringe 72, extract small dosing amounts of the coloring agent 36 and add the coloring agent 36 one drop at a time to the materials within the dispensing container. While some embodiments may temporarily store the syringe 72 within the interior portion 22 of the nozzle 20, as depicted in FIG. 17, it is further contemplated that the syringe 72 could be shaped to fit within the recess 52, in the manners described previously with respect to the supplemental container 30. In such embodiments, the bottom wall 17 will be positioned far enough from the second end portion 54 of the dispensing container to provide a sufficient cavity for storing the syringe 72. To that end, it is contemplated that both the supplemental container 30 and the syringe 72 could be simultaneously stored in the recess 52.

Figure 3:
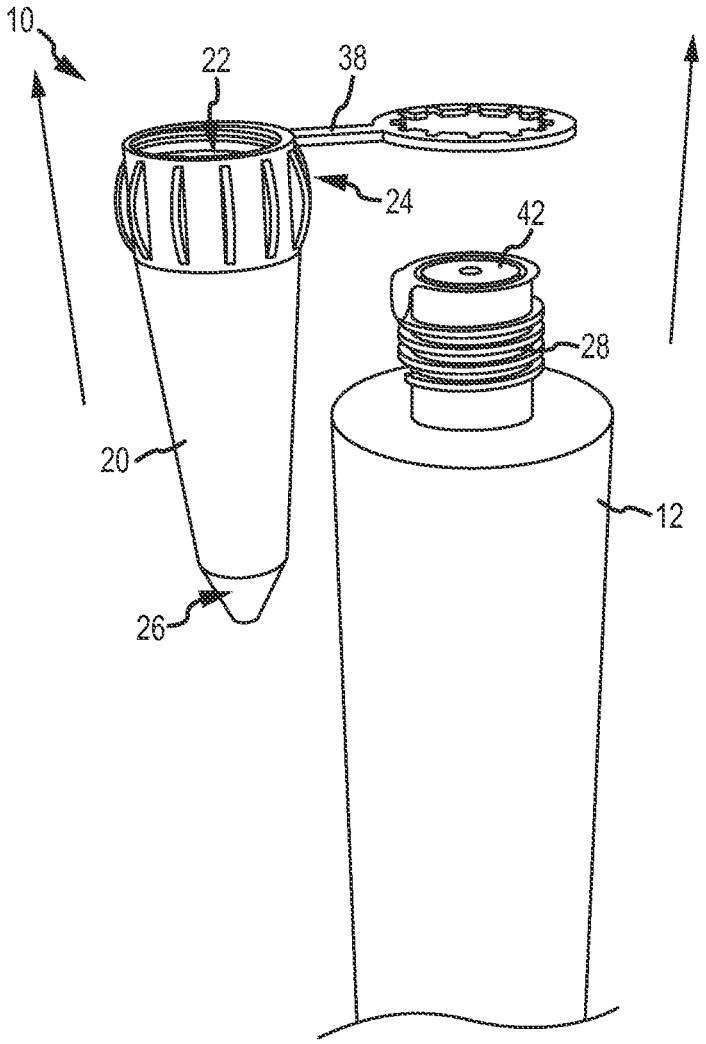
FIG. 3 depicts an isometric view of one embodiment of a nozzle and dispensing container that may be used with the system for custom coloring sealant and demonstrates one manner in which the nozzle may be removed from the dispensing container.

With reference to FIGS. 2 and 3, the nozzle 20 may be coupled with the dispensing container 12. In one embodiment, the nozzle 20 is coupled with the threaded nub 28 of the dispensing container 12 using a generally flexible strap 38 having opposite first and second end portions. In one aspect, the first end portion of the strap 38 may be provided to encircle the threaded nub 28 to keep the nozzle 20 and dispensing container 12 together during transport and storage, prior to being used. Fingers within the first end portion of the strap 38 may releasably engage the threads (or other structural feature) of the nub 28. The second end portion may be integrally or mechanically coupled with the nozzle 20 in one of various known methods.

A cap 40 may be removably coupled with the first open end portion 14 of the dispensing container 12 in a manner similar to that described herein with respect to the open first end portion 24 of the nozzle 20. The cap will provide a measure of containment and protection to the contents of the dispensing container during transport, agitation, and storage of the system 10. As such, the cap 40 may be used between uses of the system 10 after the sealant has been custom colored. Similarly, the system 10 may be provided with one or more removable seals 42 that may be secured across the first open end portion 14 of the dispensing container 12 and the open first end portion 24 of the nozzle 20. Such seals may be secured with the system 10 prior to initial transport and storage of the system 10 in order to contain and protect the contents of the dispensing container 12 and the nozzle 20 when a supplemental container 30 or other article is stored within the nozzle 20, respectively. It is contemplated that various paper, plastic and foil materials may be used when forming the seals 42. However, such materials may vary according to the circumstances and intended use of the system 10.

In at least one embodiment, such as depicted in FIG. 4, the system may be provided with a measuring cup 44 that is coupled with the open first end portion 14 of the dispensing container 12. The dispensing cup will be beneficial for metering quantities of sealant thickeners, coloring agents, or other additives. Alternatively, the nozzle 20 and/or cap 40 may be used as measuring devices obviating the need for a devoted measuring cup.

Figure 12:
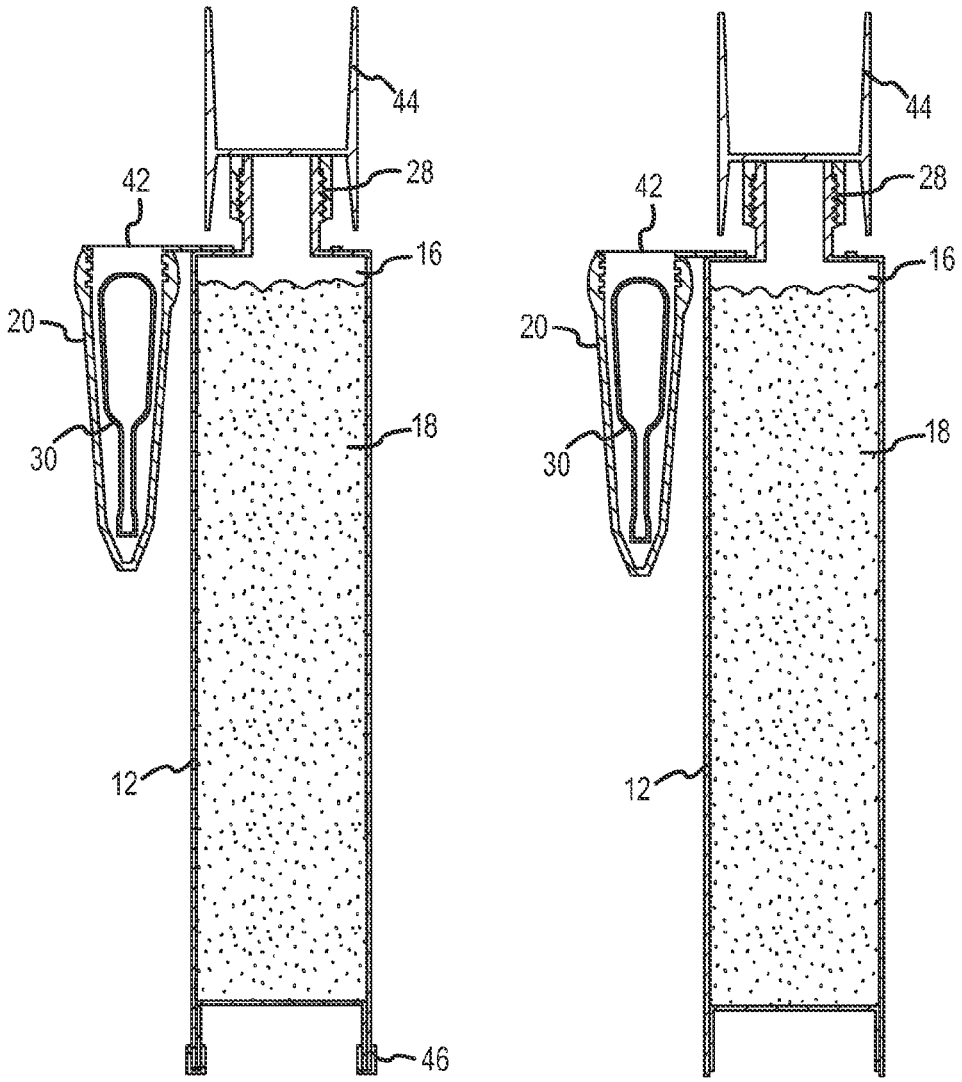
FIG. 12 depicts a front cross-sectional/elevation view of three embodiments of the system for custom coloring sealant and demonstrates various manners in which the same may be assembled prior to its use.

With reference to FIG. 12, the dispensing container 12 may be fitted with a small annular clamping ring 46 that wraps at least partially around and clamps down on the second end portion 54 of the dispensing container 12. The clamping ring may be formed from metal, plastic or other suitable materials. When the clamping ring 46 is coupled with the end of the dispensing container 12, the bottom wall 17 is prevented from being forced out of the back end of a dispensing container 12 while a user shakes or otherwise agitates the dispensing container during the colorant mixing or thickening procedures. While it is contemplated that the system 10 may be provided with a dispensing container 12 without such a clamping ring 46, a potential exists for the bottom wall 17 exiting the back end of the dispensing container 12 while it is agitated by the user. If the bottom wall inadvertently exits the back of the dispensing container 12, the contents would be ejected, creating a mess.

Figure 18:
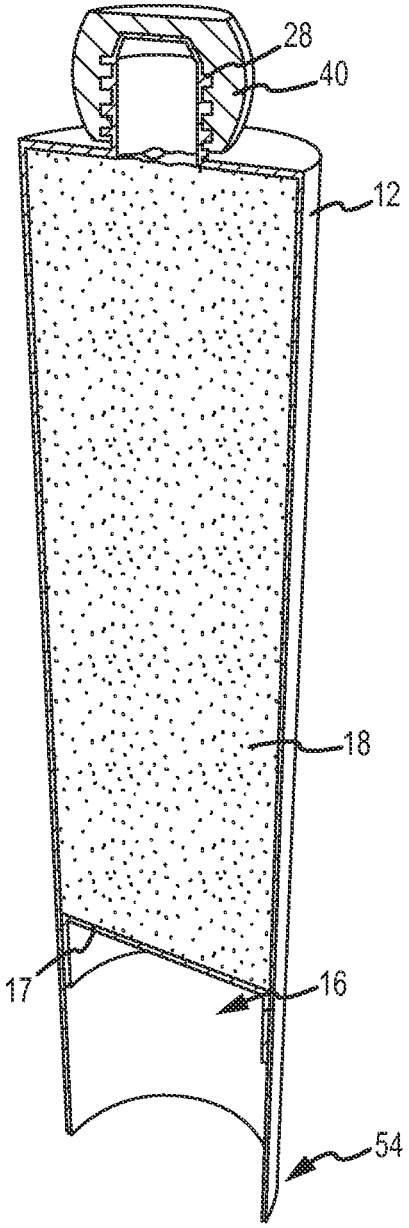
FIG. 18 depicts an isometric, cut-away view of one embodiment of a dispensing container that may be used with the system for custom coloring sealant and demonstrates one manner in which the bottom wall of the dispensing container may be placed in a first position, whereby a first volume is defined within the interior compartment of the dispensing container.
Figure 19:
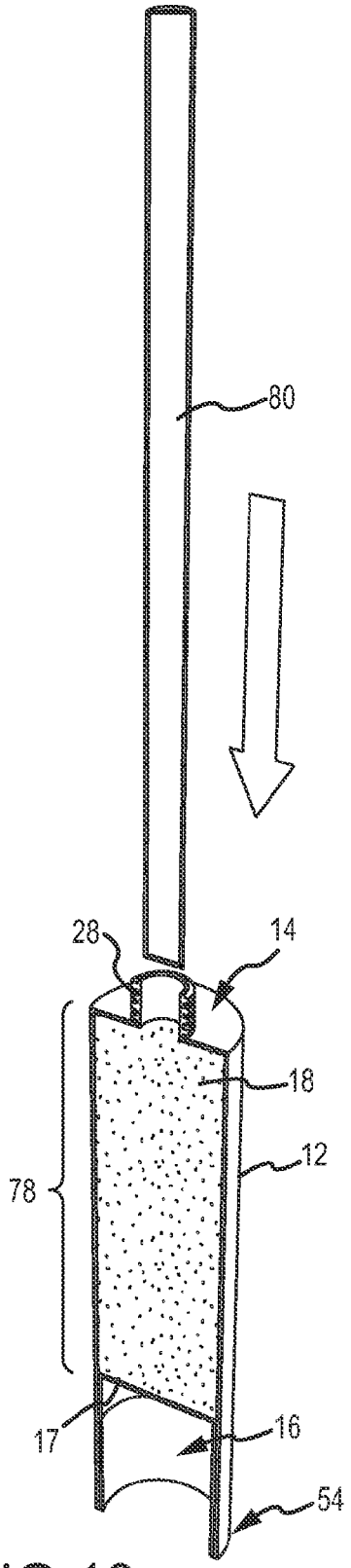
FIG. 19 depicts the dispensing container of FIG. 18 and further depicts an elongated pushrod that may be used to move the bottom wall of the dispensing container.

With reference to FIG. 19, various embodiments of the system 10 will provide a dispensing container 12 with the bottom wall 17 being located in a first position that defines a first volume 78 within the interior compartment. This first volume 78 will initially be filled with a quantity of sealant base 18 only. In some embodiments, the first volume includes a negligible headspace with the quantity of sealant base 18. A negligible headspace will typically provide an insufficient exposure of the quantity of sealant base 18 for a "skin" or partially hardened portions of the sealant base to form when the system 10 is transported and stored in hot conditions prior to use. Such a skin or partially hardened portions of the sealant base will tend to resist mixing with other components of the desired custom-colored sealing compound. However, it has been determined that proportionately small headspaces, such as that depicted in FIG. 18, are insufficient to cause a skin or partially hardened portions of sealant base to form. However, the first volume 78, resulting from the bottom wall 17 being in the first position, will be insufficient to simultaneously hold the quantity of sealant base solution and the quantity of sealant thickener 34, let alone a quantity of colorant 36. Accordingly, the user will need to move the bottom wall 17 of the dispensing container 12 into a second position, closer to the second end portion 54 of the dispensing container 12 to create a larger volume.

Figure 20:
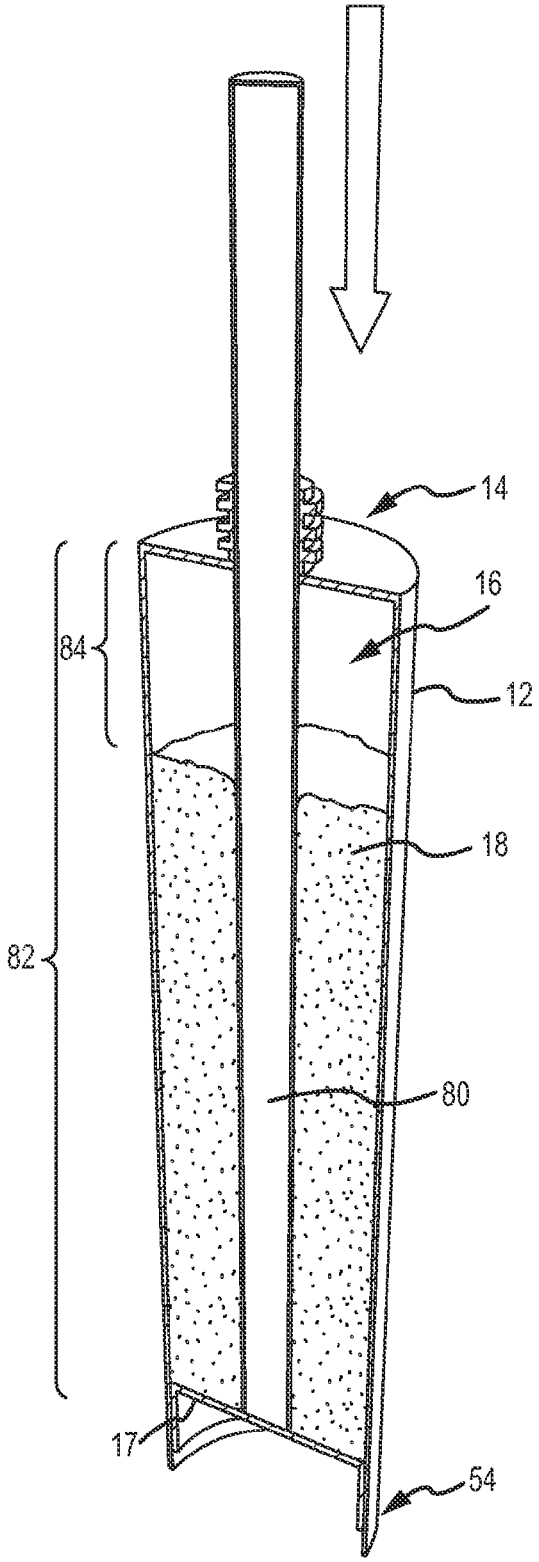
FIG. 20 depicts the dispensing container of FIG. 19 and further depicts one manner in which the elongated pushrod may be inserted into the interior compartment of the dispensing container and engaged with the bottom wall of the dispensing container until it is moved to define a second volume within the interior compartment.

With reference to FIGS. 19 and 20, the system 10 may be provided with an elongated pushrod 80 that is shaped to be selectively passed through the open first end portion 14 of the dispensing container 12. The pushrod 80 should be provided to be at least generally rigid and of a length approximating or longer than an overall length of the dispensing container 12. In this manner, one end portion of the pushrod 80 may be passed through the opening in the first end portion 14 of the dispensing container 12 until it engages the bottom wall 17 of the dispensing container 12. The user may then continue to drive the pushrod into the interior compartment 16 of the dispensing container 12, as shown in FIG. 20, such that the bottom wall 17 moves toward the second end portion 54 of the dispensing container until the bottom wall 17 reaches a second position, which defines a second volume 82. The second volume 82 will vary in its size according to the needs of the user and the custom-colored sealant being prepared. However, it is contemplated that many embodiments will provide a second volume 82, similar to that depicted in FIG. 20, that is sufficient to simultaneously hold the quantity of sealant base solution 18, the quantity of sealant thickener 34, a quantity of colorant 36, while maintaining sufficient headspace 84 to mix the contents of the second volume 82 by agitation or other means.

Figure 21:
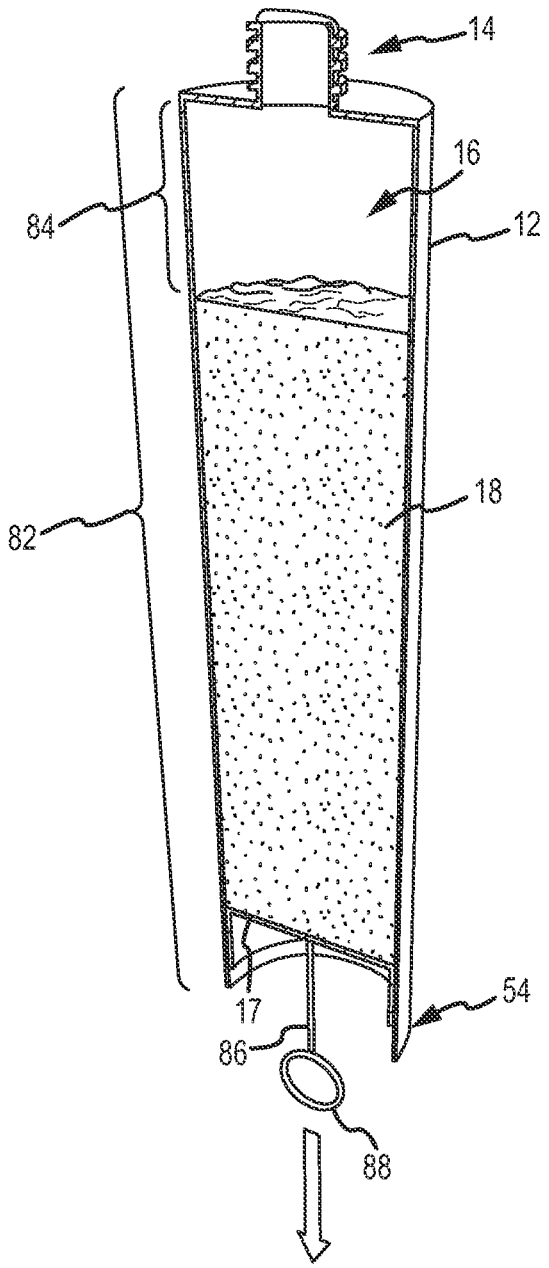
FIG. 21 depicts the dispensing container of FIG. 18 and further depicts a pull string that may be used to move the bottom wall of the dispensing container.

Other methods of moving the bottom wall 17 toward the second end portion 54 of the dispensing container 12 are contemplated. In some embodiments, the pushrod 80 may be removably secured to the surface of the bottom wall 17 that faces the second end portion 54, such as by providing one end portion of the pushrod 80 with threads that are received within a threaded socket formed on the bottom wall 17. In this manner, the bottom wall 17 may be advanced in either direction along a long axis of the dispensing container 12. In another embodiment, such as depicted in FIG. 21, a pull string 86 may be secured with the bottom wall 17, such as to the surface of the bottom wall 17 that faces the second end portion 54. A handle 88 having one of various geometries may be associated with a distal end portion of the pull string 86 to provide a user with a secure gripping mechanism for pulling the pull string 86 and advancing the bottom wall 17 toward the second end portion 54 of the dispensing container 12.

Figure 7:
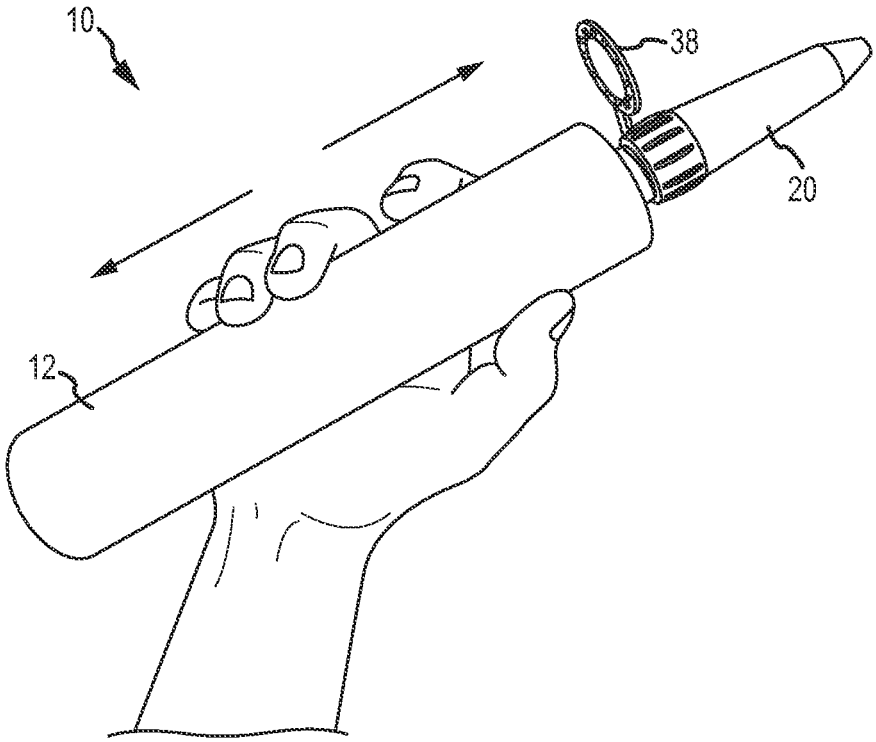
FIG. 7 depicts a perspective view of one embodiment of the system for custom coloring sealant and demonstrates one manner in which the system may be agitated to mix its contents.
Figure 8:
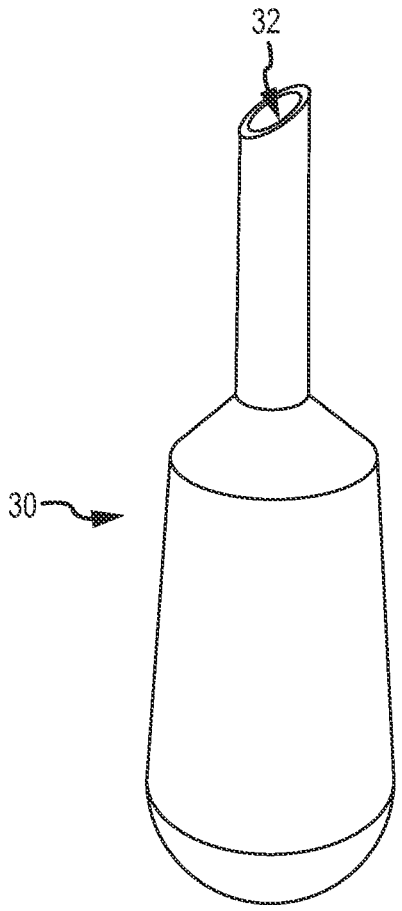
FIG. 8 depicts a front elevation view of one embodiment of a supplemental container that may be used with the system for custom coloring sealant and demonstrates one manner in which it may be opened.
Figure 9:
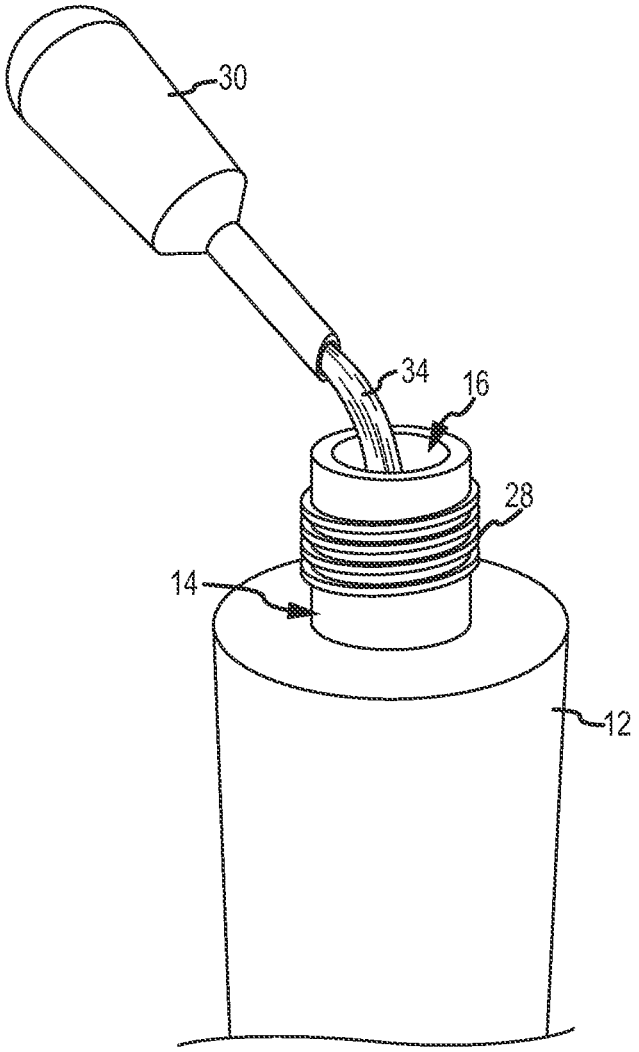
FIG. 9 is an isometric view of one embodiment of a supplemental container and dispensing container that may be used with the system for custom coloring sealant and demonstrates one manner in which the supplemental container may be used to introduce supplemental materials to the interior chamber of the dispensing container.
Figure 23:
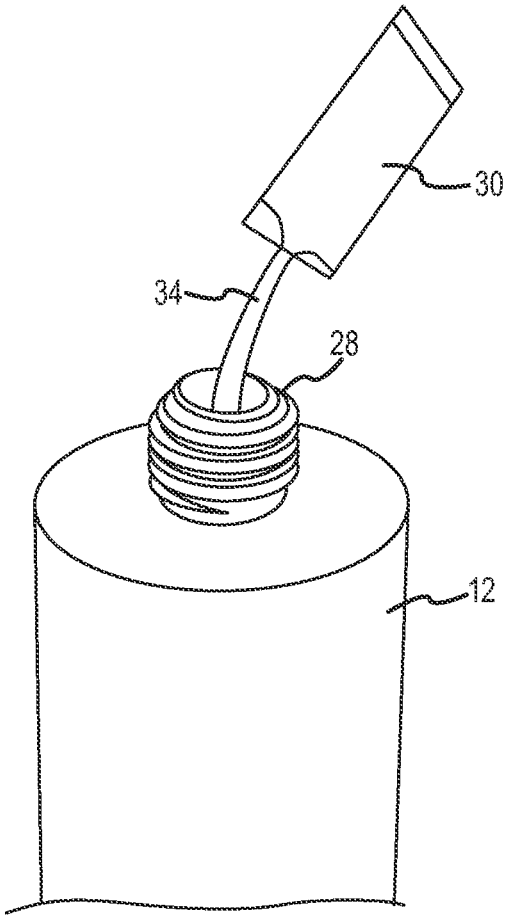
FIG. 23 depicts one embodiment of a dispensing container that may be used with the system for custom coloring sealant and demonstrates one manner in which one embodiment of a supplemental container may be used to add material, such as sealant thickener, to the interior compartment of the dispensing container.

Once the bottom wall 17 has been moved to create the second volume 84, the user may dispose a quantity of at least one coloring agent 36 into the interior compartment 16 of the dispensing container 12, such as depicted in FIG. 22. The user then agitates the contents of the interior compartment 16 of the dispensing container 12, such as by shaking the dispensing container 12 by hand as depicted in FIG. 7, until the contents are mixed. Additional coloring agent 36 may be added and subsequently mixed until the sealant base solution 18 approximates a final desired custom color. The user may then introduce a quantity of said sealant thickener 34 from the supplemental container 30 to the interior compartment 16 of the dispensing container 12, such as depicted in FIG. 23. The dispensing container should again be agitated, such as by hand shaking the dispensing container 12, until the contents are mixed throughout the length of the dispensing container 12. This step should achieve a requisite high viscosity and strongly pseudo-plastic or thixotropic rheological flow profile that is typically needed for an easily applied and non-sagging, custom colored, sealant material. A user may then operatively couple the first end portion 24 of the nozzle 20 with the first open end portion 14 of the dispensing container 12, remove a portion of the second end portion 26 of the nozzle to create a desired size and shape of sealant bead, and dispense the sealant material as desired.

The present system and method for custom coloring individual containers of sealant provide an inexpensive, highly accurate, self-contained, convenient means of measuring the proper amount of coloring agent 36 (such as a pigmented latex paint) that is to be introduced into the dispensing container 12. Once the sealant has been custom colored and thickened, it can be very easily dispensed from a rigid cartridge with a common, standard, readily available, low-mechanical-leverage caulking gun or dispensed directly from a squeeze tube by simply squeezing through a short, low-back-pressure nozzle. Accordingly, consumers and contractors are provided a self-contained, easy to use, fast, inexpensive, and convenient means of custom coloring individual containers of sealant anywhere it may be required, without the need of any additional specialized equipment, special mixing devices, or outside services. The components associated with the present system and method can be manufactured at a relatively modest cost and in a readily usable and familiar format.

Although the system has been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Since many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A kit for providing custom colored caulk; the kit comprising:

a dispensing container, having a first end portion, an open interior compartment, and a bottom wall that is selectively positionable at various locations along a long axis of the dispensing container, within the open interior compartment, toward and away from the open first end portion of the dispensing container; the bottom wall being located in a first position that defines a first volume within the interior compartment; a quantity of caulk base solution, having a viscosity of between 100 to 50,000 centipoise, disposed within the interior compartment of the dispensing container;

a nozzle, having an open interior portion and opposite first and second end portions, the first end portion being shaped and sized to be secured with the first end portion of the dispensing container so that the interior compartment of the dispensing container is placed in open fluid communication with the interior portion of the nozzle;

a supplemental container having an interior portion that is at least partially filled with a quantity of caulk thickener;

a quantity of a coloring agent; and an elongated pushrod having at least one end that is shaped to engage the bottom wall of the dispensing container and move the bottom wall along the long axis of the dispensing container, within the open interior compartment, away from the open first end portion of the dispensing container; the first volume being insufficient to simultaneously hold said quantity of caulk base solution and said quantity of caulk thickener.

2. The kit of claim 1 wherein the first volume does not include a headspace with the quantity of caulk base.

3. The kit of claim 1 wherein the first volume includes a negligible headspace with the quantity of caulk base.

4. The kit of claim 1 further comprising a cap that is removably coupled with the first end portion of the dispensing container to expose an opening extending through the first end portion into the interior compartment.

5. The kit of claim 1 wherein the elongated pushrod is shaped such that it may be selectively passed through an opening in the first end portion of the dispensing container until it engages the bottom wall of the dispensing container.

6. The kit of claim 1 further comprising a syringe having a base with open first and second end portions and an elongated plunger that is shaped to be disposed through the open second end portion of the syringe and along an open interior of the base toward and away from the open first end portion.

7. The kit of claim 6 wherein the syringe is disposed within the interior portion of the nozzle prior to using the kit.

8. The kit of claim 7 wherein the opening in the first end portion of the nozzle is temporarily closed with a removable barrier so that the syringe is not unintentionally dislodged from within the interior portion of the nozzle.

9. The kit of claim 1 wherein the bottom wall of the dispensing container is provided with a recess formed to face away from the interior compartment of the dispensing container; the supplemental container being removably disposed within the recess at the second end portion of the dispensing container.

10. The kit of claim 9 wherein an opening to the recess in the second end portion of the dispensing container is temporarily closed with a removable recess barrier that prevents the supplemental container from being unintentionally dislodged from within the recess.

11. A method of using a kit of components to produce custom colored caulk; the method comprising:

providing a dispensing container, having a first end portion, an open interior compartment, and a bottom wall that is selectively positionable at various locations along a long axis of the dispensing container, within the open interior compartment, toward and away from the open first end portion of the dispensing container; the bottom wall being located in a first position that defines a first volume within the interior compartment;

providing a quantity of liquid caulk base solution, having a viscosity of between 100 to 50,000 centipoise, within the interior compartment of the dispensing container;

providing a nozzle, having an open interior portion and opposite first and second end portions, the first end portion being shaped and sized to be secured with the first end portion of the dispensing container so that the interior compartment of the dispensing container is placed in open fluid communication with the interior portion of the nozzle;

providing a supplemental container having an interior portion that is at least partially filled with a quantity of caulk thickener;

providing a quantity of a coloring agent;

the first volume being insufficient to simultaneously hold said quantity of caulk base solution and said quantity of caulk thickener;

moving the bottom wall of the dispensing container from the first position to a second position, creating a second volume within the interior compartment; the second volume being larger than the first volume;

manually disposing a quantity of the coloring agent into the open interior compartment of the dispensing container;

agitating the contents of the interior compartment of the dispensing container until the contents are mixed and the caulk base solution approximates a final custom color;

introducing a quantity of the caulk thickener from the supplemental container to the interior compartment of the dispensing container;

agitating the contents of the interior compartment of the dispensing container until the contents are mixed and thickened; and operatively coupling the first end portion of the nozzle with the first open end portion of the dispensing container.

12. The method of using a kit of components to produce custom colored caulk of claim 11 wherein the second volume is sufficient in size to include the quantity of caulk base; the quantity of coloring agent; the quantity of thickening agent, and a headspace that is sufficient to mix the contents of the interior compartment through agitation.

13. The method of using a kit of components to produce custom colored caulk of claim 11, further comprising: providing an elongated pushrod having opposite ends; the step of moving the bottom wall of the dispensing container being performed by engaging at least one end of the elongated pushrod with the bottom wall and enacting a force on the bottom wall, through the elongated pushrod, that moves the bottom wall along the long axis of the dispensing container.

14. The method of using a kit of components to produce custom colored caulk of claim 11 wherein the steps of agitating the contents of the interior compartment are performed by manually shaking the dispensing container.

* * * * *